United States Patent [19]

Steele

[11] 4,452,191

[45] Jun. 5, 1984

[54] SHORT DURATION PTC RESISTOR TIMER

[75] Inventor: Robert E. Steele, Cortland, Ohio

[73] Assignee: General Motors Corporation, Detroit, Mich.

[21] Appl. No.: 416,211

[22] Filed: Sep. 9, 1982

[51] Int. Cl.[3] ..... F02N 17/00

[52] U.S. Cl. ..... 123/179 H; 123/179 BG; 338/23; 338/25; 361/165; 219/505

[58] Field of Search ..... 338/23, 24, 25; 361/106, 165; 307/117; 219/504, 505; 123/179 H, 179 BG

[56] References Cited

U.S. PATENT DOCUMENTS

| | | | |
|---|---|---|---|
| 3,307,167 | 2/1967 | Race . | |
| 3,486,080 | 12/1969 | Tillmann | 361/165 |
| 3,600,118 | 8/1971 | Hirsbrunner | 338/23 |
| 3,673,538 | 6/1972 | Faxon | 338/25 |
| 3,828,292 | 8/1974 | Grossman et al. | 338/23 |
| 3,916,264 | 10/1975 | Berg . | |
| 4,316,080 | 2/1982 | Wroblewski | 219/505 |

FOREIGN PATENT DOCUMENTS

| | | | |
|---|---|---|---|
| 810782 | 3/1959 | United Kingdom | 361/165 |
| 1080534 | 8/1967 | United Kingdom | 219/505 |

*Primary Examiner*—Parshotam S. Lall

*Attorney, Agent, or Firm*—Robert M. Sigler

[57] ABSTRACT

A short duration timer for use in an electronic circuit such as a diesel engine glow plug control includes a first PTC resistor energized by an electric power source and stabilized in the exponential portion of its resistance-temperature curve. A second PTC resistor in thermal contact with the first is energized at time zero from the electric power source and substantially immediately stabilizes at a temperature higher than that of the first, resulting in heat flow from the second PTC resistor to the first, and therefore an increase in the resistance of the first, at a rate which is substantially independent of variations in ambient temperature and supply voltage of the electric power source. A signal ending the time duration is generated when the resistance of the first PTC resistor has changed by a predetermined percentage. In a preferred embodiment, a third PTC resistor having a resistance-temperature characteristic substantially identical with that of the first is at least partially thermally isolated therefrom and connected in electrical series therewith to stabilize similarly. In this embodiment the end of the time duration is signalled when the resistance ratio of the first and third PTC resistors equals a predetermined value. The resulting time duration is substantially independent of variations in ambient temperature and supply voltage.

2 Claims, 9 Drawing Figures

SHORT DURATION PTC RESISTOR TIMER

BACKGROUND OF THE INVENTION

This invention relates to a short duration timer for use in electrical circuits subject to changes in environmental temperature and supply voltage in which the time duration of the timer is substantially independent of said changes. Such a timer finds particular utility in a glow plug energization control for a diesel internal combustion engine.

Timers are used for a multitude of purposes in electronic circuits. One use for a timer of very short duration is the delay of the actuation of protective shut-down circuitry following a shut-down signal to prevent unintended actuation of the shut-down circuitry by noise or other spurious signals. The duration of the time delay provided is generally substantially less than one second: for example, 0.25 seconds. This time delay must be maintained substantially constant, however, in spite of possible changes in supply voltage and ambient temperature. In a vehicle engine electronic control system, supply voltage, although regulated, does vary and can sometimes fall substantially below the rated voltage, particularly during engine starting in cold weather, when diesel engine glow plug energization control is most useful. In addition, a substantial range of ambient temperatures in the vehicle engine environment are well known to those skilled in the art of vehicle engine control. A short duration timer for use in the protective shut-down portion of the diesel engine glow plug energization control circuit should be well regulated in time duration against changes in supply voltage and ambient temperature.

SUMMARY OF THE INVENTION

Therefore it is an object of this invention to provide a short duration timer for an electronic circuit in an environment subject to changes in supply voltage and ambient temperature in which the time duration of said timer is substantially constant in spite of such changes.

This and other objects are realized in a timer having a first self-heating PTC resistor having an exponentially increasing temperature-resistance characteristic within a first temperature range and being energized electrically by an electric power source to stablize at a first stabilization temperature within the first temperature range. The timer further includes a second self-heating PTC resistor having a substantial surface in thermal contact with the first PTC resistor and further having a low resistance at the first stabilization temperature and an increasing temperature-resistance characteristic in a second temperature range higher than the first stabilization temperature. The timer further includes first means actuable to energize the second PTC resistor from the electric power source so as to substantially immediately heat it from the first stabilization temperature to a second stabilization temperature in the second temperature range and thereby cause heat flow from the second to the first resistor across the surface to change the resistance of the first PTC resistor on a percentage basis from the moment of actuation of the first means at a predetermined time rate substantially independent of changes in ambient temperature and voltage of the electric power source and second means effective to detect and signal a predetermined percentage change in said resistance to signify a predetermined time delay.

A third PTC thermistor having a resistance-temperature characteristic substantially identical with that of the first PTC thermistor may be at least partially thermally isolated therefrom and connected electrically in series therewith so that the first and third PTC thermistors stabilize at the first stabilization temperature with a constant resistance ratio. The second means in this case detects a predetermined change in the resistance ratio of the first and third PTC thermistors from said predetermined ratio. Since the percentage rate of change in the resistance of the first PTC thermistor, or the rate of change in the resistance ratio of the first and third PTC thermistors, depends solely upon the rate of heat flow from the second PTC resistor to the first PTC resistor and this rate of heat flow is substantially independent of supply voltage and ambient temperature, the time elapsed to actuation of the second means, and therefore the time duration of the timer, is also substantially independent of these environmental conditions. Further details and advantages of this invention will be apparent from the accompanying drawings and following description of the preferred embodiment.

DESCRIPTION OF THE PREFERRED EMBODIMENT

Figure 1:
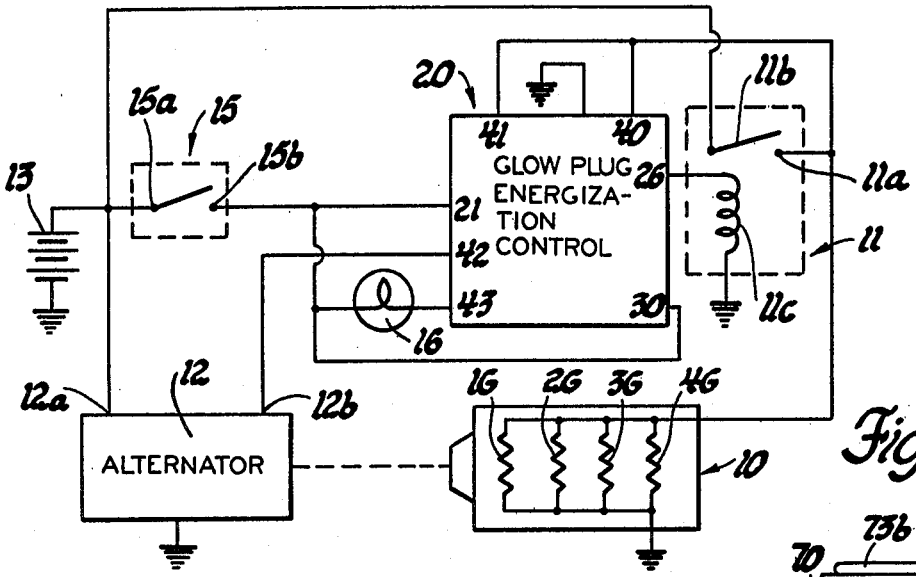
FIG. 1 shows a diesel engine with a glow plug energization control including a timer according to this invention.

In this description, the short duration timer of this invention will occur near the end, after a description of its environment. Referring to FIG. 1, a diesel engine 10 is provided with a plurality of glow plugs 1G, 2G, 3G and 4G, each associated with a respective engine 10 combustion chamber. Although the number of glow plugs is shown as 4, it is understood that there will be one glow plug for each engine combustion chamber and the number of engine combustion chambers may be greater or less than four. The glow plugs 1G–4G are connected electrically in parallel between ground and one contact **11*a* of a relay 11 having an armature 11*b* and actuating coil 11*c***.

A vehicle electrical power supply includes an automotive type alternator 12 of the type shown in the U.S. Pat. No. 3,538,362 to Cheetham et al or Steele U.S. Pat. No. 4,307,688 and a battery 13. It is understood that alternator 12 is mechanically driven by diesel engine 10 to generate electric power while engine 10 is operating and that the system is a typical automotive electric power supply system including such further items as a voltage regulator, fuses and other devices not shown. Although the voltage regulation is not perfect, the system is understood to act substantially as a source of electric current at a predetermined supply voltage of approximately 12 volts. The supply current from alternator 12 is obtained from a positive polarity output terminal **12*a* of a conventional 6** diode bridge full wave rectifier circuit, as shown in the afore-mentioned patents. Output terminal 12*a* is connected to the positive terminal of battery 13, to one side 15*a* of an ignition switch 15 and to armature 11*b* of relay 11. Alternator 12 further includes an output terminal 12*b* from the conventional diode trio, not shown, which provides the energizing current for the alternator field winding, not shown. Furthermore, a charge indicator lamp 16 of the type well known in the automotive engine art has one terminal connected to the other terminal 15*b* of the ignition switch 15. The same terminal of charge indicator lamp 16, along with the other terminal thereof, terminal 12*b* of alternator 12, one end of actuating coil 11*c*, the ungrounded ends of glow plugs 1G–4G and terminal 15*b* of ignition switch 15 are all connected to various terminals of a glow plug energization control 20, which is shown in circuit detail in FIG. 2.

Figure 2:
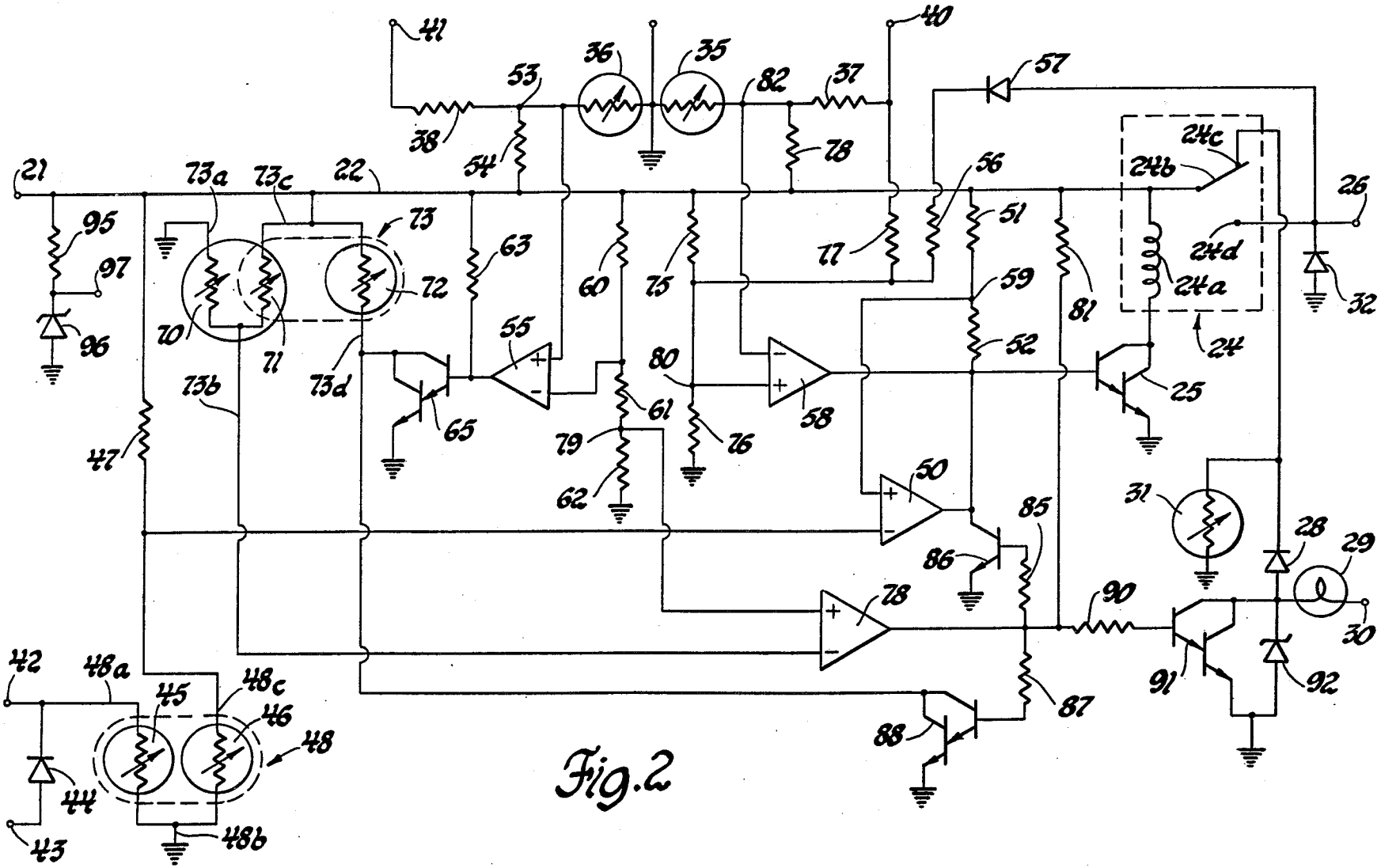
FIG. 2 shows an electrical circuit for use as the glow plug energization control in the system of FIG. 1.

Referring to FIGS. 1 and 2, terminal 15*b* of ignition switch 15 is connected to a terminal 21 of glow plug energization control 20 which, in turn, connects to a positive supply rail 22. Positive supply rail 22 is connected through an actuating coil 24*a* of a relay 24 to the collector of an NPN Darlington transistor 25 having a grounded emitter. Relay 24 further includes an armature 24*b* connected to positive supply rail 22, a normally closed contact 24*c* and normally open contact 24*d*. Normally open contact 24*d* connects with a terminal 26 of glow plug energization control 20 which is, in turn, connected through actuating coil 11*c* of relay 11 to ground. Normally closed contact 24*c* connects to the cathode of a diode 28 the anode of which is connected through an indicator or "wait" lamp 29 to a terminal 30 of glow plug energization control 20, which terminal 30 is connected to contact 15*b* of ignition switch 15. Normally closed contact 24*c* of relay 24 is further connected through a positive temperature coefficient (PTC) thermistor 31 to ground. A diode 32, the cathode of which is connected to terminal 26 of glow plug energization control 20 and the anode of which is grounded, serves as a free wheeling diode for the actuating coil 11*c* of relay 11. Lamp 29 is a standard 3 candle power, wedge base 14 volt, 360 ma indicating lamp of the kind in standard use within automotive dashboard displays.

Figure 9:
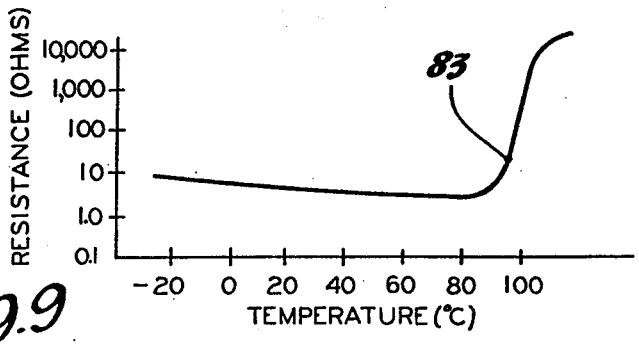
FIG. 9 shows a curve of resistance versus temperature for a typical PTC thermistor.

PTC thermistor 31 and other PTC thermistors or resistors to be identified below are of the type having a resistance versus temperature characteristic curve as shown in FIG. 9. As seen in this curve, the PTC thermistor is characterized by a substantially constant resistance throughout a first temperature range and an abrupt increase in resistance at a switch temperature which marks the upper boundary of the first temperature range with a much higher resistance in a second temperature range above the switch temperature. The resistance in the first temperature range is generally from six to twelve ohms; and the resistance may increase in exponential fashion by several orders of magnitude to hundreds or thousands of ohms within the second temperature range. The PTC thermistor may be manufactured with a specified switch temperature and may be, for example, a resistor such as one designated RL3006-50-90-25-PTO, marketed by Keystone Carbon Company, Thermistor Division, St. Mary's, Pa. and having a switch temperature of 90° C. As an electrical resistor, a PTC thermistor will generate heat, when a voltage is supplied thereacross to generate a current therein, at the rate $V^2/R$, where V is the applied voltage and R is the resistance thereof. It will further lose heat to the environment at a rate which, although perhaps not completely independent of the applied voltage, varies far less therewith than the rate of heat generation. For a given set of environmental and design parameters, there is a certain voltage applied to a PTC thermistor below which the heat generation rate will be less than or equal to the heat loss so that the temperature thereof does not increase, no matter how long the voltage is applied. On the other hand, if a greater voltage is applied, the generated heat will be greater than the heat loss and the temperature will gradually increase at a rate which increases with the applied voltage. As it increases throughout the first or lower range, the resistance will remain substantially constant at approximately six to seven ohms. However, when the temperature reaches the switch temperature, the resistance will increase by a substantial factor in a short time and the increase resistance decreases the generated heat until the resistance stabilizes at a stabilization temperature within the second temperature range.

Indicator lamp 29 is also a PTC resistance device. It further requires a minimum energization voltage, which is not necessarily the same as that of PTC thermistor 31, to glow in a visible manner. When lamp 29 is unenergized, it produces little heat so that it does not substantially increase in temperature and has a characteristic resistance of approximately four ohms. If the minimum energization voltage is exceeded, however, the lamp will glow and produce sufficient heat to very quickly increase its resistance to approximately 40 ohms. The time lag in the increase of resistance for indicator lamp 29 is approximately one second, substantially less than that of PTC resistor 31 for voltages less than 12 volts.

If indicator lamp 29 and PTC resistor 31, here used as a timer of a kind not according to this invention, are connected in series across a source of current at a sufficient supply voltage (such as 12 volts), the lamp will be energized and, within about one second, increase its resistance to 40 ohms compared to about six ohms for the timer 31, so that the majority of the supply voltage is dropped across the lamp. The portion of the supply voltage dropped across timer 31 was only about 60 percent of supply voltage for the first second and then drops to about 13 percent of supply voltage, which is less than the minimum energization voltage thereof so that it does not substantially increase its temperature or its resistance and the lamp remains lit. However, if the timer 31 had been in its high temperature, high resistance state at the time when the current source at the supply voltage was connected across the series combination, timer 31 would have presented a resistance of hundreds of ohms or more compared with the four ohms of the lamp so that the portion of the supply voltage dropped across lamp 29 would not exceed the minimum energization voltage thereof and almost all the supply voltage would be applied to timer 31 to maintain its temperature and resistance; and lamp 29 would remain unenergized.

Referring back to FIG. 2, the operation of these devices within the circuit will now be explained. When ignition switch 15 is closed so that contacts 15*a* and 15*b* are connected, current may flow from the supply battery 13 at a supply voltage of 12 volts through positive supply rail 22 actuating coil 24*a* of relay 24 and through Darlington transistor 25, if it is conducting, to ground. By the operation of the remainder of circuit 2, which will be explained at a later point in the specification, if engine 10 is sufficiently cold that glow plug energization is required, Darlington transistor 25 will be placed in a conducting state when ignition switch 15 is closed. Thus, armature 24*b* will be actuated to connect with normally open contact 24*d* to actuate relay 11 and thus energize glow plugs 1G–4G. At the same time, contact between armature 24*b* and normally closed contact 24*c* will be broken. The closure of ignition switch 15 further provides current flow through indicator lamp 29, diode 28 and PTC thermistor 31 to ground. If both indicator lamp 29 and PTC thermistor 31 are cold, as would ordinarily be the case upon cold start of engine 10, the first of the situations as described above will occur, with indicator lamp 29 lighting to indicate to the driver that the glow plugs are in their initial energization and the engine not ready for start; and PTC thermistor 31 will remain substantially cold and low in resistance.

The signal that the initial energization of glow plugs 1G–4G should end causes Darlington transistor 25 to become nonconducting and allows relay armature 24*b* to return to its normal position in contact with normally closed contact 24*c*. This, of course, causes the deactivation of relay 11 to deenergize glow plugs 1G–4G and further connects the cathode of diode 28 directly to the positive supply rail 22. Thus a shunt current path is provided from battery 13 and alternator 12 by way of ignition switch 15, positive supply rail 22 and relay armature 24*b*, around lamp 29 and diode 28, directly to PTC thermistor 31, which now receives the full supply voltage. Lamp 29 immediately deenergizes and quickly cools to decrease its resistance to four ohms. PTC thermistor 31 is now energized with full supply voltage and, after a time lag, abruptly increase its resistance. When Darlington transistor 25 is once again activated to cause the actuation of relays 24 and 11 and reenergize glow plugs 1G–4G for the first of the cyclical energizations, armature 24*b* breaks contact with normally closed contact 24*c* of relay 24, thus breaking the shunt path around indicator lamp 29. Now, however, the second situation as described above exists. PTC thermistor 31 has a resistance so high, in comparison with the four ohms resistance of lamp 29, that it still retains substantially the entire voltage drop of the supply voltage from battery 13 so that the voltage applied to lamp 29 is less than its minimum energization voltage. Current flows through indicator lamp 29 to maintain PTC thermistor 31 in its high resistance state; however, that current does not cause lamp 29 to glow or to increase its resistance substantially. Thus, throughout the subsequent cyclical energizations of glow plugs 1G–4G, lamp 29 will remain deenergized. Lamp 29 is seen to be what is often called the "wait" lamp, since its purpose is to signal the operator to wait before starting the engine.

If, when ignition switch is initially closed, the engine is sufficiently warm that no energization of glow plugs 1G–4G is necessary, Darlington transistor 25 will not be made conducting upon the closure of ignition switch 15 and armature 24*b* will remain in contact with normally closed contact 24*c* to provide full supply voltage to PTC thermistor 31 and a shunt current path around lamp 29 from the beginning. Thus lamp 29 will not light at all and PTC thermistor 31 will eventually increase its resistance to further assure that lamp 29 does not light. Thus the circuit provides for energization of the indicator lamp only if the glow plugs are actually energized and only for the initial energization thereof.

The glow plug control itself is similar to that shown in the aforementioned patent to Steele U.S. Pat. No. 4,307,688 in many respects. A pair of PTC thermistors 35 and 36 are identical to those similarly numbered PTC thermistors in the aforementioned Steele patent. PTC thermistor 35 is connected between ground and one end of a resistor 37, the other end of which is connected to a terminal 40 of glow plug energization control 20. PTC thermistor 36 has one end grounded and the other connected to a resistor 38, the other end of which is connected to a terminal 41 of glow plug energization control 20. Both terminals 40 and 41 are connected to the common ungrounded ends of glow plugs 1G–4G. Resistors 37 and 38 are current limiting resistors and the connections are such that PTC thermistors 35 and 36 are provided with a voltage at the same time as the glow plugs 1G–4G. PTC thermistors 35 and 36 and resistors 37 and 38 are all included in a package which may be separate from the remainder of glow plug energization control 20, which package is mounted on the engine cooling jacket to be sensitive both to engine temperature and the self-heating effect of current therethrough. The current through resistor 37 and PTC thermistor 35 is such as to cause PTC thermistor 35 to increase its temperature at such a rate that it will abruptly increase in resistance at the point where the glow plugs 1G–4G are sufficiently hot as to require deenergization. Resistor 38 and PTC resistor 36 perform a similar function, but with a higher switch temperature to serve as a backup in case there is a failure of the PTC thermistor 35 or the primary control circuit to be described below.

A voltage comparator 58 has an inverting input connected to the junction 82 of PTC thermistor 35 and resistor 37, a noninverting input connected to a junction 80 between a resistor 75 connected to the positive supply rail 22 and a resistor 76 connected to ground, and an output connected to the base of Darlington transistor 25. Junction 80 is further connected through a resistor 77 to terminal 40 and through a resistor 56 to the cathode of a diode 57, the anode of which is connected to normally open contact 24*d* of relay 24; and junction 82 is further connected to the positive supply rail 22 through a resistor 78. Resistor 75, at 14.3 K, and resistor 76, at 1.54 K help determine a reference voltage at the noninverting input of comparator 58 which depends upon the voltage at terminal 40 applied through resistor 77 at one K. When the glow plugs are energized, battery voltage of approximately 12 volts is applied to terminal 40 and the reference voltage at the noninverting input of comparator 58 is approximately 7.5 volts. When battery voltage is removed from glow plugs 1G–4G, however, terminal 40 is essentially grounded through the negligible resistance of the four glow plugs in parallel and the reference voltage at junction 80 is approximately 0.45 volts. The voltage at junction 82, which also depends upon the voltage at terminal 40 as well as the temperature and therefore the resistance of PTC thermistor 35, is compared with the voltage at the junction 80 by voltage comparator 58 in order to control the conducting state of Darlington transistor 25. When ignition switch 15 is initially closed, the reference voltage at junction 80 is initially 0.45 volts, since the relays have not yet had a chance to actuate and terminal 40 is thus essentially grounded. If engine 10 is hot, the voltage divider of resistor 78 and PTC thermistor 35 will generate a voltage at junction 82 greater than 0.45 volts and the output transistor of voltage comparator 58 will be made conducting to ground in order to sink the current from a series pair of 5K resistors 51 and 52 connected between positive supply rail 22 and the base of Darlington transistor 25. The base will thus be held at one diode drop above ground; Darlington transistor 25 will not conduct and the glow plugs will not be energized.

However, for normal cold engine starting, the resistance of PTC thermistor 35 will be approximately 6 ohms and the voltage at junction 82 will be approximately 0.30 volts. The output transistor of comparator 25 will thus turn off; and Darlington transistor 25 will be biased conductive to actuate relays 24 and 11 and cause the energization of glow plugs 1G–4G. With that energization, 12 volts are supplied to terminal 40, which causes the voltage at junction 80 to jump to approximately 7.5 volts and the voltage at junction 82 to jump to approximately 4.0 volts. The glow plugs remain energized and PTC thermistor 35 begins to increase its temperature and, therefore, its resistance. When the voltage at junction 82 exceeds that at junction 80, Darlington transistor 25 is turned off to deenergize the glow plugs and ground terminal 40. The voltage at junction 80 once again drops to 0.45 volts. The voltage on junction 82 also drops, but not as far, and then begins to slowly decrease as PTC thermistor cools. When the voltage on junction 82 once again falls below the voltage on junction 80, both voltages jump upwards once again with a smaller jump for the voltage on junction 82. PTC thermistor 35 heats again; the voltage on junction 82 rises; and the process is repeated indefinitely until Darlington transistor 25 is finally clamped in an off condition by additional circuitry yet to be described.

Figure 6:
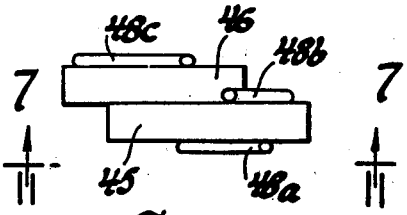
FIGS. 6–8 show top view, side view and equivalent circuit, respectively, of another PTC thermistor device for use in the circuit of FIG. 2.
Figure 8:
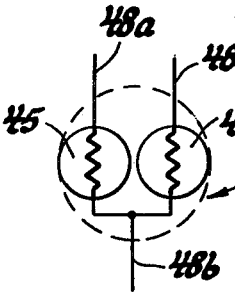
Figure 7:
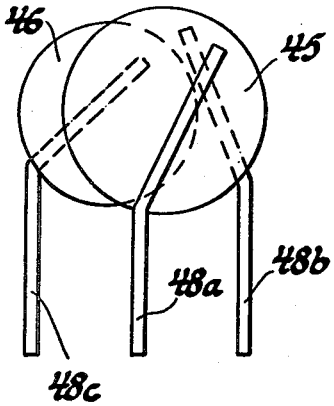

The glow plug energization control further includes a terminal 43 connected to charge indicator lamp 16 and a terminal 42 connected to terminal 12*b* of alternator 12. Terminal 42 is connected to the cathode of a diode 44, the anode of which is connected to terminal 43. Terminal 42 is further connected through a PTC thermistor 45 to ground. Another PTC thermistor 46 forms the lower half of a voltage divider with a resistor 47 between the positive supply rail 22 and ground. PTC thermistors 45 and 46 are physically assembled into an afterglow timer device 48 as shown in FIGS. 6, 7 and 8. As seen in these Figures, afterglow timer 48 comprises a pair of disk-shaped PTC thermistor elements having a substantial portion of one flat face of each joined in a thermally conducting manner. Each of the flat faces is coated with a metallic conductor and leads are attached to the three metallic conductors as shown: lead 48*a* to the outer face of PTC thermistor element 45, lead 48*b* to the common metallic conductor on the inner faces of the PTC thermistor elements 45 and 46 and lead 48*c* on the outer face of PTC thermistor element 46. PTC thermistor 45 is large in thermal mass compared with PTC thermistor element 46 and has a switch temperature of 120° C. as opposed to a 50° C. switch temperature for PTC thermistor element 46. Afterglow timer 48 is another timer of a kind different from that of this invention.

Lead 48*c*, which is connected to resistor 47, is further connected to the inverting input of a voltage comparator 50 having a noninverting input connected to the junction 59 of resistors 51 and 52. The output of comparator 50 is further connected to the base of Darlington transistor 25. Since resistors 51 and 52 each have a value of 5 kilohms and the voltage at the output of comparator 58 will be one or two diode drops above ground depending upon its state, the voltage applied to the noninverting input of comparator 50 will be approximately six volts. One of the functions of afterglow timer 48 is to prevent energization of the glow plugs if the engine ambient temperature exceeds 50° C. PTC thermistor element 46, in a voltage divider with one K resistor 47, will have a resistance sufficiently low to provide a small voltage to the inverting input of comparator 50 and thus allow Darlington transistor 25 to be controlled by comparator 58 when the ambient temperature of the engine is less than 50° C. However, if the ambient engine temperature is greater than 50° C. upon the closure of ignition switch 15, the resistance of PTC thermistor 46 will be greater than one K and a voltage higher than six volts will be applied to the inverting input of comparator 50. This will cause the output of comparator 50 to provide a diode path to ground in series with resistors 51 and 52 and thereby clamp Darlington transistor 25 in a nonconducting condition.

The afterglow timer function itself operates in the following manner. Assuming an engine ambient temperature below 50° C., comparator 50 is unactivated at the time of the closure of ignition switch 15. Upon closure of ignition switch 15, current flows from battery 13 to ground through ignition switch 15, charge indicator lamp 16, diode 44 and the parallel combination of PTC thermistor element 45 and circuitry within alternator 12 and the voltage regulator. The voltage drop across PTC thermistor element 45, however, is two volts or less, which is insufficient to cause thermistor 45 to significantly increase in temperature. When the operator starts engine 10, alternator 12 begins generating and a higher voltage appears at terminal 42 to be applied directly across PTC thermistor element 45. Thermistor 45 begins to generate heat sufficient to increase the temperature of the combination of thermistors 45 and 46. When the temperature of the afterglow timer 48 reaches 50° C., the resistance of PTC thermistor 46 increases abruptly to cause voltage comparator 50 to turn off Darlington transistor 25 and hold it off. The delay between the start of engine 10 and the switching of voltage comparator 50 is the afterglow period, which will be seen to vary in an inverse fashion with the initial ambient temperature of engine 10.

However, the heating of afterglow timer 48 does not end at 50° C. but continues until PTC thermistor 45 abruptly increases its resistance at a temperature of 120° C., thus causing PTC thermistor 46 to also reach that temperature. Thus, if engine 10 is shut off, the current through PTC thermistor 45 stops; but it takes some time before the afterglow timer 48 decreases once again to 50° C. During this time, if ignition switch 15 is closed, comparator 50 will continue to hold Darlington transistor 25 in a nonconducting position and no glow plug energization will be allowed. This is the third function of afterglow timer 48.

As mentioned previously, PTC thermistor 36 operates similarly to PTC thermistor 35 but with a higher switch temperature to act as a backup unit therefor. The junction 53 between PTC thermistor 36 and resistor 38 is connected to the positive supply rail 22 through a resistor 54 and is further connected to the noninverting input of a voltage comparator 55 having an inverting input connected through a resistor 60 to positive supply rail 22 and through series resistors 61 and 62 to ground. The output of comparator 55 is further connected through a resistor 63 to positive supply rail 22 and is also connected to the base of an NPN Darlington transistor 65 having a grounded emitter. The voltage divider comprising the resistor 60 over the series resistors 61 and 62 establishes a reference voltage at the inverting input of comparator 55 sufficiently high to turn on the output transistor thereof when the resistance of PTC thermistor 36 is low and thereby hold the base of Darlington transistor 65 below its emitter voltage to maintain it nonconducting. If PTC thermistor 36 reaches its switch temperature, however, and its resistance rises, the voltage applied to the noninverting input of comparator 55 will exceed the reference voltage on the inverting input and the output transistor thereof will be turned off to allow resistor 63 to bias Darlington transistor 65 into a conducting state.

The conduction of Darlington transistor 65 thus indicates an overheat condition and is adapted to deenergize the glow plugs 1G–4G. However, in order to prevent inadvertent deenergization of the glow plugs due to a noise spike or other momentary disturbance in the collector voltage of Darlington transistor 65, a short delay, on the order of 0.25 seconds, is introduced in the deenergization of the glow plugs through a short delay timer comprising PTC thermistor or resistor elements 70, 71 and 72 as shown in FIG. 2 and also in FIGS. 3–5.

Figure 3:
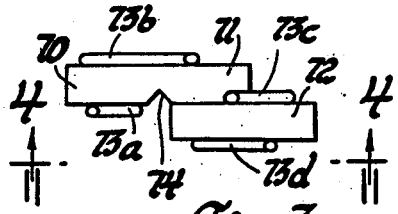
FIGS. 3–5 show top view, side view and equivalent circuit, respectively, of a PTC thermistor timer according to this invention for use in the circuit of FIG. 2.
Figure 4:
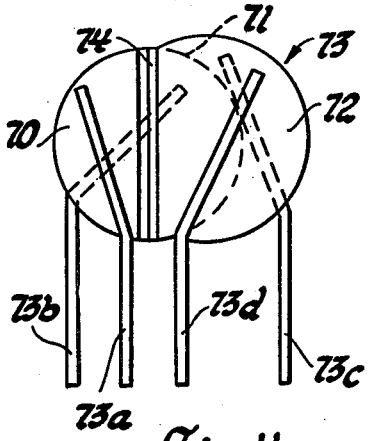
Figure 5:
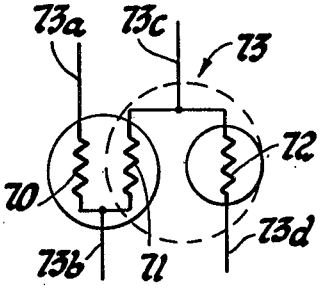

Referring to FIGS. 3 and 4, PTC thermistor elements 70 and 71 are formed from a single disk of PTC thermistor material which is partially divided by a V-shaped groove 74 in such a way as to partially restrict the flow of heat across said groove. The groove marks the boundary between PTC thermistors 70 and 71. Dividing groove 74 also forms a break in a metallic coating on the corresponding flat side of the disk; and there is an unbroken metallic coating on the opposite flat side. PTC thermistor 72 is a similar disk of PTC thermistor material which has a flat side partially joined to the flat side of PTC thermistor 71 and truncated at groove 74. It also has metallic coatings on its opposite flat surfaces. The construction of the short delay timer 73 is such that PTC thermistors 70 and 71 have substantially identical resistance and heat characteristics, however, the flow of heat therebetween past groove 74 is restricted in comparison with the flow of heat through the large junction between the PTC thermistor elements 71 and 72. A plurality of leads are provided: lead **73*a* on the free side of thermistor 70, lead 73*b* on the opposite side of the disk which is the junction of thermistors 70 and 71, lead 73*c* on the junction of resistors 71 and 72 and lead 73*d* on the free side of thermistor 72**.

In the circuit of FIG. 2, lead **73*a* is connected to ground, lead 73*c* is connected to positive supply rail 22, lead 73*d* is connected to the collector of Darlington transistor 65 and lead 73*b* is connected to the inverting input of a voltage comparator 78 having a noninverting input connected to the junction 79 of resistors 61 and 62. Upon closure of ignition switch 15, thermistor 71 and 70 are connected in series across battery 13. Since thermistors 71 and 70 are substantially identical and are not completely thermally isolated, they will have substantially identical resistances which will remain substantially identical as the pair starts to increase in temperature. When the temperature of the pair finally reaches the common switch temperature, the resistances will substantially increase to decrease the heat generation and the device will stabilize at a stabilization temperature with the resistances of thermistor 70 and 71 still being substantially identical. There is no current flow as yet through thermistor 72 and the reference voltage from junction 79 is lower than the substantially one-half supply voltage supplied to the inverting input of comparator 78. The output of comparator 78 is connected to positive supply rail 22 through a resistor 81, which supplies collector current for the output transistor of comparator 78, which is in a conducting state. The output of comparator 78** thus maintains a low voltage, one diode drop above ground.

It will be seen by reference to the curve of FIG. 9 that the thermistors 70 and 71 are being maintained at a point referenced with numeral 83 which is in the lower part of the exponential portion of the curve. Thus, if either of thermistors 70 or 71 is heated above this stabilization temperature by an outside source, its resistance will increase very quickly. When Darlington transistor 65 is turned on due to an overheat signal from PTC thermistor 36 through comparator 55, PTC thermistor 72 is immediately connected directly across the battery 13. It immediately begins to generate heat which flows across the large common boundary into thermistor 71 and immediately begins to increase the resistance of thermistor 71 adjacent this boundary. Since the heat must flow a greater distance to get to the boundary between thermistors 70 and 71 and that boundary itself is small and restricted in surface area compared with that between thermistor 71 and 72, the effect is that of the sudden large supply of heat to thermistor 71 which is not immediately supplied to thermistor 70. Thermistor 71 therefore begins increasing in temperature and therefore in resistance at a rapid rate which is to a great degree independent of both ambient temperature outside short duration timer 73 and the supply voltage. The voltage divider formed by thermistor 71 and 70 thus rapidly changes its ratio in the decreasing direction and, after a time delay which is primarily determined by the physical design of the short duration timer 73 itself and not affected much by changes in supply voltage or ambient temperature, causes comparator 78 to switch off its output transistor.

The previous statement that the time delay of timer 73 is substantially independent of changes in supply voltage and ambient temperature is explained as follows. When the circuit is closed through Darlington transistor 65, almost full supply voltage is connected abruptly across thermistor 72. Thermistor 72 is made thin for a small thermal mass consistent with a large area of contact with thermistor 71; and it thus increases temperature quickly with the sudden heat generation. The device can be designed so that the temperature of thermistor 72 increases in a time much less than 0.25 second to its own stabilization temperature, which is slightly higher than the stabilization temperature of thermistors 71 and 70, and thus the initial temperature of thermistor 72. The time of this temperature rise is, of course, dependent on supply voltage; but it is so small incomparison with the remainder of the time delay that any such variation is inconsequential.

Therefore, upon actuation of the timer, thermistor 72 is substantially immediately heated to a predetermined higher temperature to create a predetermined temperature difference between thermistors 72 and 71. The rate of heat flow from thermistor 72 to thermistor 71 depends only on this temperature difference and the internal characteristics of the device and is therefore substantially independent of ambient temperature and supply voltage variations. Since the resistance-temperature characteristic for thermistor 71 in this range is substantially exponential, a predetermined temperature increase in a given time will produce a predetermined percentage resistance increase. Thermistors 71 and 70 and resistors 60, 61 and 62 form a bridge circuit across the supply voltage with thermistors 71 and 70 on one side and the pair of resistors 60, 61 and resistor 62 on the other, with balance detected by comparator 78. The bridge starts in a condition of imbalance with a predetermined resistance ratio of thermistors 71 and 70 on one side and a constant higher resistance ratio of resistors 60, 61 and 62 on the other with the resistance of thermistor 71 beginning to increase at the time of actuation at a constant percentage rate. Thus the bridge will be in balance at a predetermined time after actuation regardless of supply voltage variations.

It should be noted at this point that total independence of the time delay from variations in supply voltage and ambient temperature would require similar total independence of the difference in stabilization temperatures as discussed above, and these temperatures do vary with these factors. However, changes in the stabilization temperatures of thermistors 70 and 71 and thermistor 72 will be in the same direction with changes in supply voltage or ambient temperature and can be expected to occur in at least similar amounts. Therefore, the difference may be considered substantially independent of such factors within practical limits.

The output of comparator 78 is connected through a resistor 85 to the base of an NPN transistor 86 having a grounded emitter and a collector connected to the base of Darlington transistor 25. It is also connected through a resistor 87 to the base of an NPN Darlington transistor 88 having a grounded emitter and a collector connected to lead **73*d* of short duration timer 73. It is further connected through a resistor 90 to the base of an NPN Darlington transistor 91 having a grounded emitter and a collector connected through lamp 29 to terminal 30 of glow plug energization control 20**.

Therefore, when comparator 78 turns off its output transistor, resistor 81 provides biasing current to turn on transistor 86 which turns off Darlington transistor 25 to deenergize glow plugs 1G–4G, to turn on Darlington transistor 88 which maintains the current flow through thermistor 72 and thus latch off comparator 78, and to turn on Darlington transistor 91 to provide a low resistance shunt current path around PTC thermistor 31 and thus energize lamp 29 as a warning to the vehicle operator that an overheat condition has occurred. An overheat condition thus causes the system to latch into a condition with the glow plugs deenergized and the wait lamp energized as a warning until the ignition switch is once again opened.

Additional circuit elements of interest are resistor 95 supplying electric power from supply rail 22 by terminal 97 to the voltage comparators and protective zener diodes 92 (for transistor 91) and 96 (for the voltage comparators). In addition, diode 57 and resistor 56 provide hysteresis feedback in the glow plug control circuit.

The embodiments of the invention in which an exclusive property or privilege is claimed are defined as follows:

1. An accurate short duration timer comprising, in combination:

an electric power source;

first and third self-heating PTC resistors having substantially identical exponentially increasing resistance-temperature characteristics within a first temperature range, said resistors being at least partially thermally isolated from each other and energized electrically in series from said electrical power source to stabilize at a first stabilization temperature within said first temperature range;

a second self-heating PTC resistor having a substantial surface in thermal contact with the first resistor, the second resistor having a low resistance at the first stabilization temperature and a steeply increasing resistance-temperature characteristic in a second temperature range higher than the first stabilization temperature;

first means actuable to energize the second resistor from said electric power source so as to substantially immediately heat it from the first stabilization temperature to a second stabilization temperature within said second temperature range, whereupon heat flows from the second resistor to the first resistor across said surface and the resistance of the first resistor changes its value on a percentage basis in comparison to its resistance prior to said energization and therefore in in comparison to the resistance of the third resistor, from the moment of actuation of the first means at a time rate substantially independent of changes in ambient temperature and voltage of the electric power source; and second means effective to detect and signal a predetermined percentage change in the resistance of the first resistor in comparison with that of the third resistor, whereby a predetermined time elapses between the actuation of the first means and the signal from the second means.

2. An accurate short duration timer comprising, in combination:

an electric power source;

first and third self-heating PTC resistors having substantially identical exponentially increasing resistance-temperature characteristics within a first temperature range, said resistors being at least partially thermally isolated from each other and energized electrically in series from said electric power source to stabilize at a first stabilization temperature within said first temperature range and maintain a substantially constant resistance ratio in the absence of unequal heating;

a second self-heating PTC resistor having a substantial surface in thermal contact with the first resistor, the second resistor having a low resistance at the first stabilization temperature and a steeply increasing resistance-temperature characteristic in a second temperature range higher than the first stabilization temperature;

first means actuable to energize the second resistor from said electric power source so as to substantially immediately heat it from the first stabilization temperature to a second stabilization temperature within said second temperature range, whereupon heat flows from the second resistor to the first resistor across said surface and the resistance ratio of the first and third resistors changes from said constant resistance ratio at a time rate substantially independent of changes in ambient temperature and voltage of the electric power source;

fourth and fifth resistors connected in series across said electric power source in a bridge circuit with said first and third self-heating PTC resistors, said fourth and fifth resistors defining a substantially constant predetermined reference voltage ratio at their junction; and voltage comparing means effective to detect and signal equal voltages at the junctions of the first and third self-heating PTC resistors and the fourth and fifth resistors and thus equal resistance ratios of the aforesaid pairs of resistors, whereby a predetermined time elapses between the actuation of the first means and the signal from the voltage comparing means.

* * * * *